United States Patent [19]

Hergeth

[11] Patent Number: 4,678,128

[45] Date of Patent: Jul. 7, 1987

[54] FIBER-BALE PLUCKER

[76] Inventor: Hubert A. Hergeth, Kockerellstrasse 3, D-5100 Aachen, Fed. Rep. of Germany

[21] Appl. No.: 821,994

[22] Filed: Jan. 24, 1986

[30] Foreign Application Priority Data

Feb. 2, 1985 [DE] Fed. Rep. of Germany ..... 3503523

[51] Int. Cl.[4] ..... D01G 7/06

[52] U.S. Cl. ..... 241/101 A; 19/80 R; 83/348; 104/161

[58] Field of Search ..... 241/101 A, 58, 60; 19/80 R, 80 A; 104/161; 83/348

[56] References Cited

U.S. PATENT DOCUMENTS 4,365,764 12/1982 Marx ..... 241/101 A 4,475,269 10/1984 Goldammer ..... 241/101 A X 4,514,881 5/1985 Hergeth et al. ..... 19/80 R 4,544,106 10/1985 Hackenbeck et al. ..... 241/101 A

*Primary Examiner*—Frank T. Yost

*Attorney, Agent, or Firm*—Karl F. Ross; Herbert Dubno

[57] ABSTRACT

A fiber-bale mill comprises a cutting device which is movable over a row of fiber bales. A collector passage is open on top below the cutting device which travels to and fro. An air passage in a cutting device through which the cut fibers are drawn from the vicinity of the cutting mechanism communicates with the passage. A cover strip at least partially covers the top of the collector passage to maintain a reduced pressure therein. Guide rollers for the cover strip are provided on the cutting device, to lift the cover strip from the collector passage at the location, at which the air passage opens into the collector passage and guide the cover strip over the portion of the air passage opening into the collector passage.

8 Claims, 3 Drawing Figures

FIBER-BALE PLUCKER

FIELD OF THE INVENTION

My invention relates to a fiber-bale plucker and, more particularly, to a machine for plucking fibers free from bales of pressed fibers which can be from various sources when fiber mixtures are to be provided. Such apparatus is utilized in the textile industry.

BACKGROUND OF THE INVENTION

An apparatus for plucking fibers from fiber bales comprising pressed fiber materials and assembled in a row can have a cutting member traveling to and fro over the row of fiber bales and progressively lowered to mill fibers from the tops of the bales. These devices are also known as bale mills.

The apparatus can have a horizontally movable cutting device comprising a cutting member which can be raised or lowered and formed with at least one cutter roller, and an air passage through which the fibers which may have the form of tufts or the like plucked off by the cutting member can be sucked continuously from the vicinity of the cutter roller into a fixed collector passage which is connected to a vacuum source. The top of the collector passage is sealed by a cover strip, which is released only at the entrance mouth, i.e. the location at which the air passage from the cutting device opens into it.

It is known to attach each end of the cover strip, which is approximately twice as long as the collector passage, to an edge of the entrance mouth and to guide it from there around a first guide roller provided at one end of the collector passage, under the collector passage to a second guide roller provided at the other end, and from there to the other edge of the entrance mouth where it is attached. The cover strip slides, therefore, on the upper side of the collector passage with the back and forth motion of the cutter device, and is acted upon by friction developed on the upper side of the collector passage, so that it wears quickly and, therefore, must be replaced often.

In order to avoid the friction developed between the moving cover strip and the collector passage, it is known to use a cover strip which is more than three times as long as the collector passage and to attach it at one end of the collector passage; from that end this cover strip extends along the top of the collector passage to a guide roller provided adjacent one edge of the entrance mouth of the air passage by which it is guided upwards; then the cover strip extends back to said end of the collector passage above the point at which it is attached; then the cover strip passes around a guide roller mounted at the aforementioned end of the collector passage and under the collector passage, around a guide roller provided at the other end of the collector passage, to a guide roller provided at the outer edge of the entrance mouth of the air passage and from there runs along the top of the collector passage back to the other end of the collector passage where it is attached. Of course, then the surface of the cover strip does not move relative to the collector passage when the cutting device moves, and friction due to such motion is eliminated. However, a cover strip of an excessive length and four guide rollers for diverting the strip by 180 degrees are required.

In another arrangement one end of a cover strip is attached to one end of the collector passage, and its other end is wound and unwound about a roller provided adjacent the entrance mouth of the air passage of the cutting apparatus and driven by a motor. On the other side of the entrance mouth a slider for closing the other portion of the collector passage is provided. This arragement, of course, avoids excessive length for the cover strip, but requires an additional motor, which moreover develops considerable heat and may cause a variety of maintenance problems.

OBJECT OF THE INVENTION

It is an object of my invention to improve a fiber-bale mill comprising a cutting device which is movable along a row of fiber bales, means defining an upwardly open collector passage over which said cutting device travels back and forth and positioned parallel to said row of bales, fibers cut being drawn to said collector passage through an air passage in said cutting device, and a cover strip, covering said collector passage and which is not exposed to excessive wear and does not an excessive length nor require a motor.

SUMMARY OF THE INVENTION

These objects and others which will become more readily apparent hereinafter are attained in accordance with my invention in a fiber-bale mill of said kind by providing an upper and a lower guide means for said cover strip on said cutting device which lift said cover strip from said collector passage at a location at which said air passage opens into said collector passage, and guide said cover strip over a part of said air passage opening into said collector passage.

Preferably, the upper and lower guide means comprise a plurality of free running guide rollers which are movable in a vertical direction, i.e., generally perpendicular to the horizontal collector passage.

Advantageously, the lower guide means is pressed from above toward the collector passage by a first pressing means, preferably formed by at least one spring.

Furthermore, the upper guide means may be pressed from below against the cover strip by a second pressing means, preferably formed by at least one spring.

The lower guide means can comprise two free running guide rollers each positioned adjacent an opposing edge of the mouth of the air passage opening into the collector passage, and the upper guide means can comprise one or two free-running guide rollers positioned substantially parallel to each other.

The apparatus according to my invention has the advantage that it requires neither an excessively long cover strip, nor an additional drive for the cover strip, nor a series of guide rollers mounted at several positions along the strip or the passage significantly spaced from each other. As opposed to the earlier apparatus, moreover, my invention has the advantage of an extremely simple construction as well as the advantage that a simply made sealing strip, and a high vacuum in the collector passage can be used.

Further this structure also permits an arbitrarily long travel for the cutting device over the rails it is mounted on. Moreover my invention provides a high flexibility to the user; for example, two cutters can operate on the same collector passage for plucking bales of two bale rows on opposite sides of the rails. Further with two such cutting devices, when a sliding partition member is mounted in the passage the parts of the fibers from the two cutters, different kinds of fiber, or the like can be simultaneously recovered without contamination of one by the other.

In double-headed cutting devices two mouths from two second air ducts can open into the same opening to the collector passage. Two separate entrance mouths can be formed by dividing that opening by a slider, and one kind of fiber can be sucked to one passage end and the other kind can be sucked to the other passage end.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
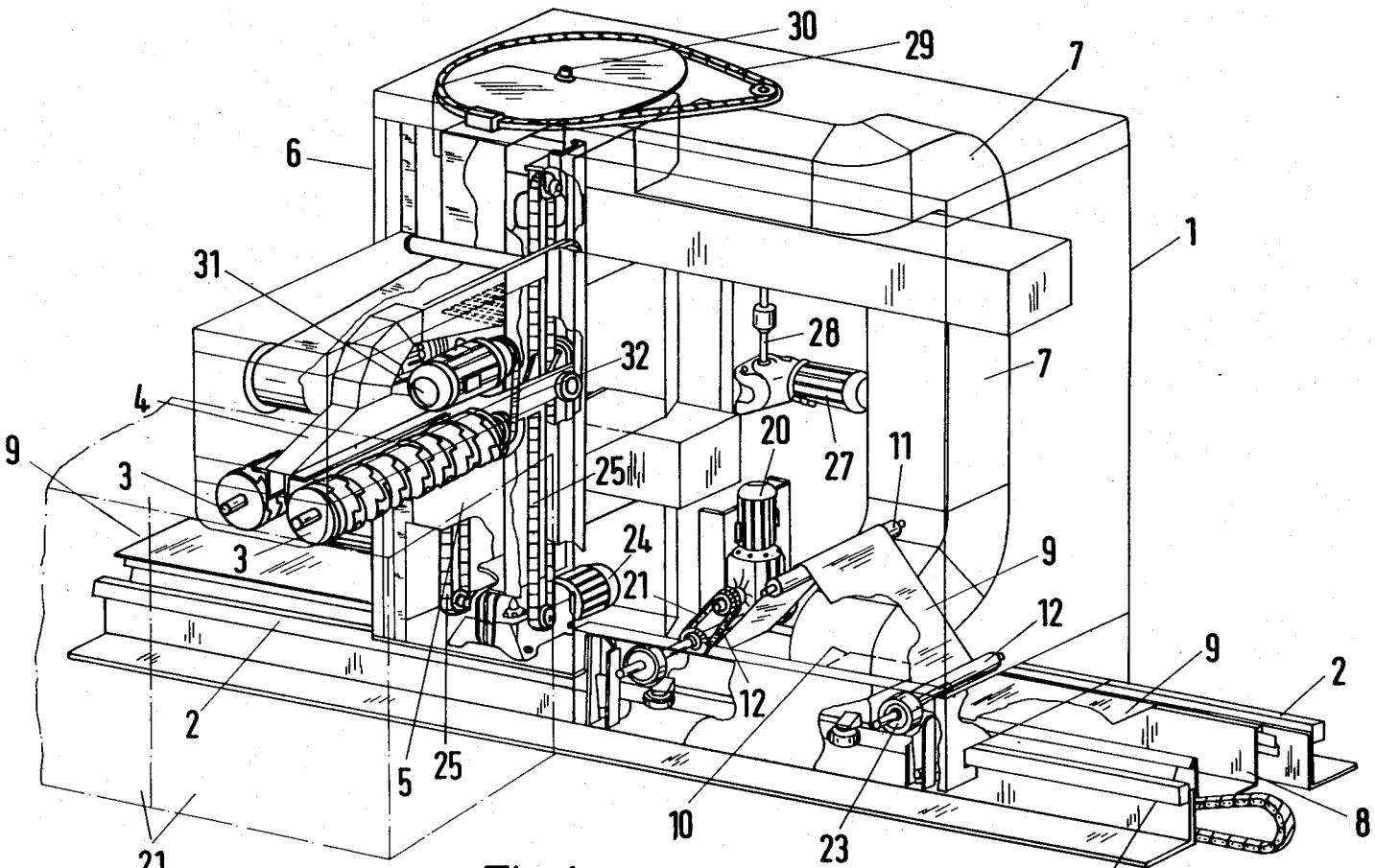
FIG. 1 is a perspective view of a preferred embodiment of a fiber bale-mill according to my invention.
Figure 2:
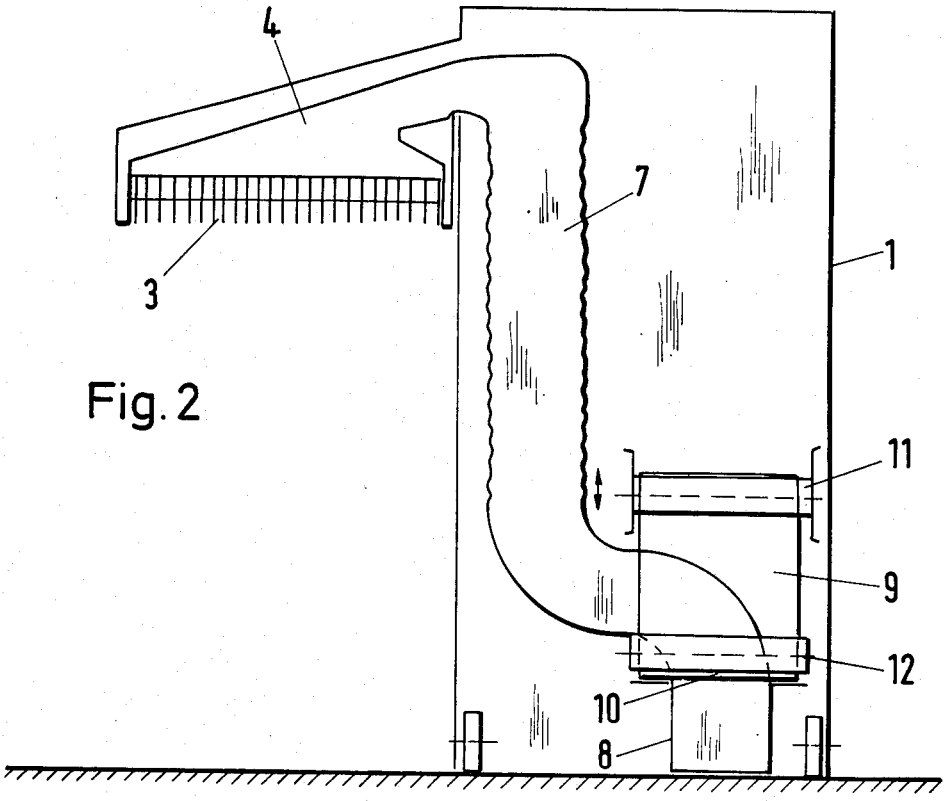
FIG. 2 is an even more diagrammatic vertical cross sectional view through the apparatus according to FIG. 1 taken in a vertical plane through the mouth of the air duct of the cutting device which opens into the collector passage.

The cutting device depicted in FIG. 1 comprises a frame 1 traveling back and forth on two parallel rails 2 along a row of fiber bales 21 shown in dot-dash lines in FIG. 1. The frame 1 has rollers 22 and 23 resting on said rails 2; the rollers 22 are drivable by a motor 20 by means of a chain 21. A casing member 6 is connected to the frame 1 by a vertical axis 30 drivable by a motor 27 by means of a shaft 28 and a chain 29 to turn the casing member to the opposite side of the rails to allow cutting of bales mounted on the other side of the rails 2. The casing member 6 is movable on the frame 1 vertically by a motor 24 by means of chains 25. At the casing member a cutting device is provided consisting of two milling rollers 3 rotatable on parallel axes drivable by a motor 31 by means of chains 32.

Fibers are milled from the fiber bales 21 by cutter rollers 3, and are drawn away through an inlet funnel 4 and then sucked through a first air duct 5 of a casing member 6 into a second air duct 7 of the frame 1.

The second air duct 7 opens into a collector passage 8 which is connected to a suction source. The upwardly open channel-shaped collector passage 8 is sealed by a cover strip 9, each end of which is attached to an end of the collector passage 8. The mouth 10 of the second air duct 7 facing the collector passage 8 carries a brush border for effective sealing opposite the collector passage 8.

On the frame 1 of the cutting device movable back and forth along the collector passage 8 two free running guide rollers 12 are mounted one adjacent each opposing side of the mouth 10 of the second air duct 7 substantially perpendicular to the direction of travel of the cutter device, and in the vicinity of these guide rollers 12 one free running guide roller 11 is mounted above the entrance mouth 10. The cover strip 9 is pressed by the guide rollers 12 on the upper side of the collector passage 8 and passes from the guide rollers 12 to the guide roller 11, which guides it over the portion of the second air duct 7 immediately above the mouth 10.

Figure 3:
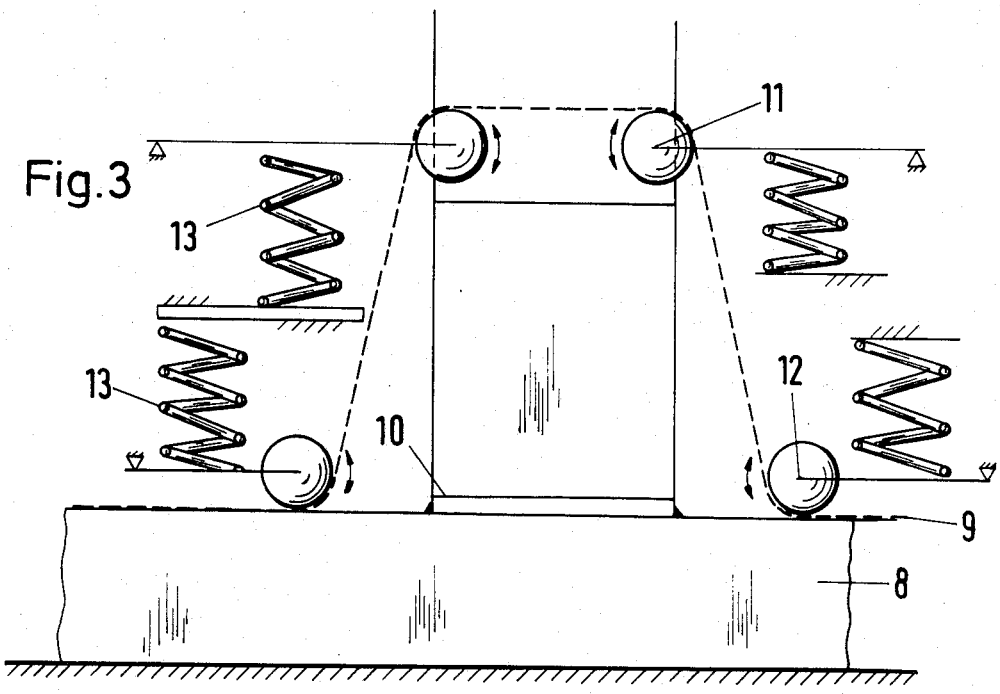
FIG. 3 is a highly diagrammatic vertical cross sectional view through the apparatus of FIG. 1 taken along the section line III—III in FIG. 2.

Instead of one guide roller 11 shown in FIG. 1 two parallel guide rollers 11 may be used as shown in FIG. 3. The guide rollers 11 and 12 are movable in the vertical direction on arms 50, 51 pivotally mounted at 52, 53. The guide rollers 12 are pressed toward the collector passage 8 by springs 13 and the guide rollers 11 are pressed upwardly by springs 13' bearing on the arms 50, 51 and bearing upon seats 54, 55.

I claim:

1. In a fiber-bale mill comprising a cutting device which is movable along a row of fiber bales, means defining an upwardly open collector passage over which said cutting device travels back and forth and positioned parallel to said row of bales, fibers being drawn to said collector passage through an air passage in said cutting device, and a cover strip at least partially covering said collector passage, the improvement wherein an upper and a lower guide means for said cover strip are provided on said cutting device which lift said cover strip from said collector passage at a location at which said air passage opens into said collector passage, and guide said cover strip over a part of said air passage opening into said collector passage.

2. The improvement according to claim 1 wherein said upper and said lower guide means each comprise a plurality of free running guide rollers.

3. The improvement according to claim 1 wherein said upper and said lower guide means are movable in a vertical direction.

4. The improvement according to claim 1 wherein said upper and said lower guide means are both movable in a direction perpendicular to said cover strip towards or away from a plane of said cover strip.

5. The improvement according to claim 4 wherein said lower guide means are pressed from above on said collector passage by a first pressing means.

6. The improvement according to claim 5 wherein said lower guide means comprise two free running guide rollers, and said first pressing means comprises at least one spring.

7. The improvement according to claim 4 wherein said upper guide means is pressed from below against said cover strip by a second pressing means.

8. The improvement according to claim 7 wherein said upper guide means comprises two free running guide rollers, and each of said free running guide rollers is mounted in said cutting device adjacent the mouth of said air passage which opens into said collector passage, and said second means comprises at least one spring.

* * * * *